United States Patent [19]

Scholl

[11] 4,108,516

[45] Aug. 22, 1978

[54] CENTRAL LOCKING MECHANISM

[75] Inventor: Eugen Scholl, Gaildorf-Adelbach, Fed. Rep. of Germany

[73] Assignee: Wilhelm Bott KG, Gaildorf, Fed. Rep. of Germany

[21] Appl. No.: 730,470

[22] Filed: Oct. 7, 1976

[30] Foreign Application Priority Data

Oct. 8, 1975 [DE] Fed. Rep. of Germany ..... 2544994

[51] Int. Cl.[2] ..... E05B 65/46

[52] U.S. Cl. ..... 312/216; 312/218; 312/221

[58] Field of Search ..... 312/216, 107.5, 221, 312/218

[56] References Cited

U.S. PATENT DOCUMENTS

| | | | |
|---|---|---|---|
| 1,063,844 | 6/1913 | Swanson | 312/221 |
| 1,370,089 | 1/1921 | Chipperfield | 312/218 |
| 2,810,616 | 10/1957 | McClellan | 312/218 |
| 2,829,021 | 4/1958 | Wolters | 312/218 |
| 2,908,538 | 10/1959 | Stegmaier | 312/218 |
| 2,992,056 | 7/1961 | Thielker | 312/221 |
| 3,284,149 | 11/1966 | Lewin | 312/218 |
| 3,371,974 | 3/1968 | Vermeersch | 312/218 |
| 3,799,638 | 3/1974 | Faiks | 312/216 |
| 3,883,200 | 5/1975 | Latham | 312/216 |
| 3,965,707 | 6/1976 | Byars et al. | 312/216 |

FOREIGN PATENT DOCUMENTS

| | | | |
|---|---|---|---|
| 142,633 | 2/1948 | Australia | 312/218 |
| 1,553,575 | 6/1969 | Fed. Rep. of Germany | 312/216 |
| 847,221 | 9/1960 | United Kingdom | 312/221 |

*Primary Examiner*—Paul R. Gilliam
*Assistant Examiner*—Victor N. Sakran

[57] ABSTRACT

In the blocked position of the central locking mechanism the locking bolt projects into the path of a blocking face of the drawer and can be elastically displaced when closing a drawer which is still open. In the open (unblocked) position of the central locking mechanism a stopping face which is arranged at a distance from the blocking face butts against a lever arm of the locking bolt when withdrawing the drawer and swivels the locking bolt into the blocking position; when closing the drawer the locking bolt is swivelled back into the release position.

5 Claims, 4 Drawing Figures

CENTRAL LOCKING MECHANISM

Another patent application of the same assignee describes a central locking mechanism for an item of furniture with a plurality of drawers arranged in a series side by side or one above the other, each of said drawers having an integral blocking projection which is arranged transversely to the sliding direction of the drawer and having a locking bolt extending beyond all drawers which can be swivelled about a stationary axis into the motion path of the blocking projections, said stationary axis running parallel to the longitudinal axis of the locking bolt so that closed drawers cannot be withdrawn. In the blocked position of the central locking mechanism the locking bolt can be swivelled against the force of a spring out of the blocked position when the opened drawer is closed and which is connected with a lever arm which, in the release position of the locking bolt, projects into the path of a stopping face which is arranged on each drawer in such a manner that upon opening of a drawer the stopping face butts against the lever arm and swivels the locking bolt into the locked position. This other patent application provides a simple possibility to design a central locking mechanism in such a manner that, on the one hand, drawers which are still opened can be closed in the blocked position of the central locking mechanism and that, on the other hand, one single drawer can respectively be opened in the case of normal operation of the item of furniture. Thus, the risk is avoided that the item of furniture will tip over when force is applied to open the drawer while other are locked.

In the embodiment described in the other patent application the stopping face constitutes a surface of the blocking projections facing in the direction of opening. The present invention improves the function of the central locking mechanism described in the other patent application in that the stopping face is arranged at a distance from the blocking projection. The advantage of this arrangement is that it is made possible in a simple manner to prevent the withdrawal of further drawers when the first withdrawn drawer is only withdrawn a short length, for example 5 to 10 mm from the completely closed position. Depending on the design of the locking bolt the stopping face may be arranged in front of the blocking projection so that the blocking projection is located between the stopping face and the rear wall of the cabinet or alternatively the stopping face may also be arranged behind the blocking projection. In a further embodiment of the invention the stopping face is arranged on a further projection. This makes it easier to use angle sections with equal legs for the bolt and the lever arm.

In one embodiment of the invention, the locking bolt and lever arm are formed by the legs of a angle section; in particular, a rectangular angle section can be used. Thus, in an advantageous manner, a particularly simple manufacture is ensured.

The swivel axis of the locking bolt and hence of the angle section can for example run through the vertical line of the angle section, however, in one embodiment of the invention the swivel axis of the locking bolt runs within the angle of the angle section. On the one hand, this offers the advantage of a particularly simple manufacture and, on the other hand, it is thus possible to arrange the swivel axis in close vicinity to an imaginary plane which connects the free leg ends with one another; this may be advantageous for the function of the central locking mechanism.

In one embodiment of the invention an oblique face is provided at the drawer for displacing the lever arm when the drawer is pushed in. This offers the advantage that drawers which are still opened can easily be closed when the locking bolt is in the position permitting release of the drawer as well as when the locking bolt is in the position locking the drawer against withdrawal. This is particularly important if, for example, several drawers have been withdrawn for maintenance purposes and must subsequently be pushed in again.

In the aforementioned other patent application a pivotable or bistable member is described which is coupled with a locking bolt and which has the function of retaining the locking bolt respectively in one of two predetermined positions. The bistable member shall be designed such that its pivotable position is not inadvertently changed even in the case of heavy vibrations of the cabinet. In a central locking mechanism in which a plate is arranged to swivel about a swivel axis of the locking bolt and in which a part being coupled with the actuating member of the central locking mechanism engages the plate in such a manner that the plate is swivelled upon actuation of said actuating member and in which a bistable member is arranged on the plate, said bistable member connecting the plate with the locking bolt and having a two-armed lever which is swivably arranged on the plate, one arm of the lever having an elongated slot extending in the longitudinal direction of the lever, said elongated hole being engaged by a pin which is connected to the locking bolt, said pin being located closer to the swivel axis of the locking bolt than the swivel axis of the lever and the other arm of the lever being connected with the swivel axis of the locking bolt via a tension spring, it is provided, according to a further development of the invention, that the swivel angle of the two-armed lever between the two stable positions of the bistable member is at least 45°. In particular, the swivel angle may for example be 90°. The advantage of this embodiment consists in that an undesired change of the tilting position can be prevented due to the large swivel angle and that nevertheless only a relatively weak spring is required for the tilting member so that no large force is required for the change-over of the bistable member, for example, when withdrawing or pushing in a drawer and that consequently the operation of the item of furniture is not impeded.

Further features and advantages of the invention will become apparent from the following description of one embodiment of the invention on the basis of the drawings which shows details that are essential for the invention and from the claims. The individual features may be applied either individually or in any desired combination of a plurality of such features. In the drawings FIG. 1 is a partially broken top view of a device according to the invention which is installed into a cabinet with a plurality of drawers which are arranged one above the other, with the lock being unlocked;

Figure 1:
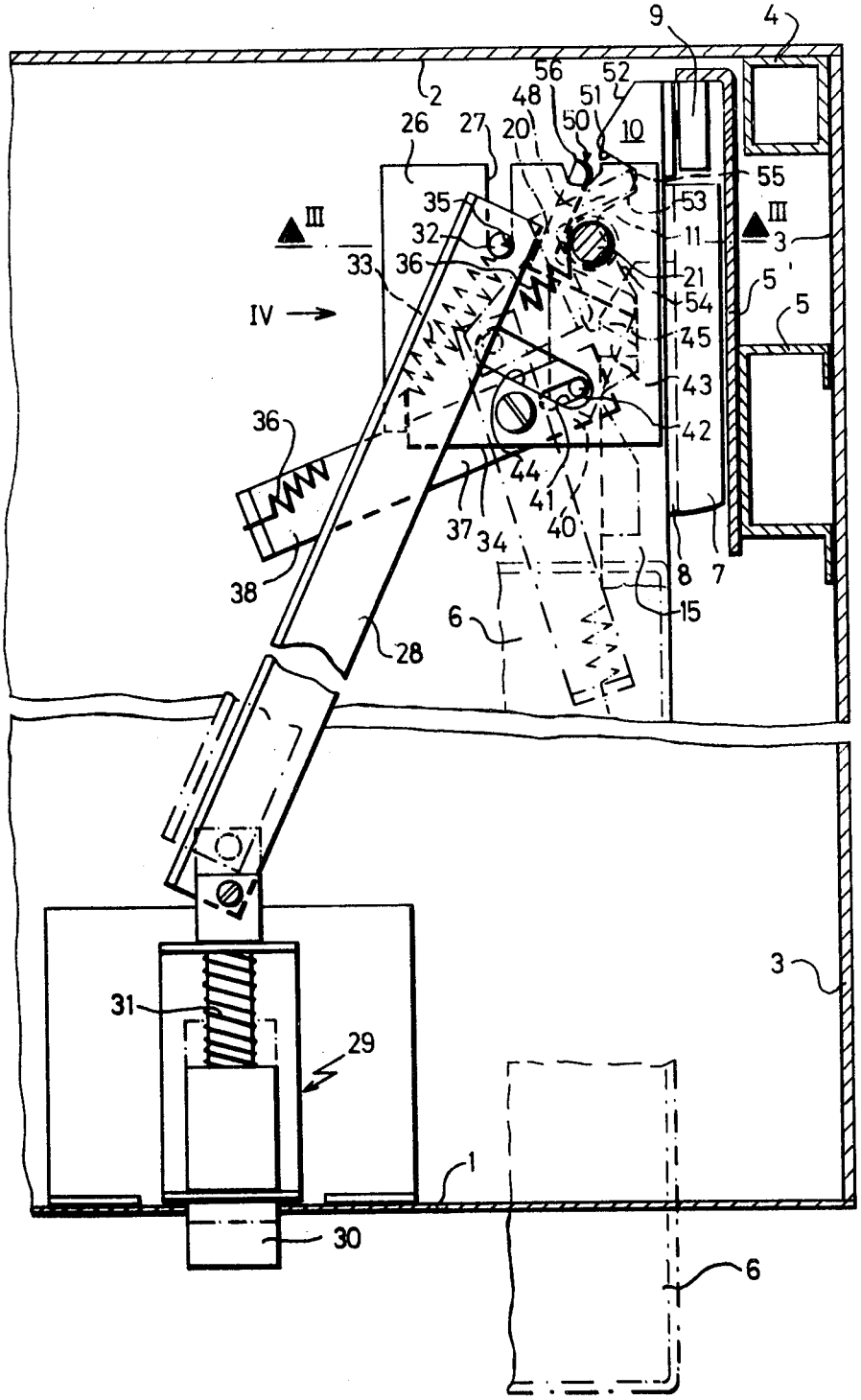

In FIG. 1 only some parts of a cabinet in which the device according to the invention is arranged are represented. The Figure shows a portion of the front wall 1 of the metal cabinet, moreover the RH rear corner with the rear wall 2 and the RH side wall 3 of the cabinet. The rear wall 2 and the side wall 3 are connected with one another by means of a metal section 4. Out of the plurality of drawers which are arranged one above the other only the RH rear corner of a drawer 6 in the partially withdrawn position is represented by chain-dotted lines. The drawer is connected with the Z-section 7 from metal which rearwardly projects over the rear wall of the drawer. In FIG. 1 the Z-section 7 is represented with solid lines and at the invisible places with dotted lines, in the position which it has with the drawer being completely pushed in. Moreover, the Z-section is represented by chain-dotted lines in a position in which the drawer is slightly withdrawn. At the rear end portion of the vertically arranged web 8 of Z-section 7 a roller 9 with a horizontal axis of rotation is disposed with the aid of which the drawer 6 can be displaced on a runner rail which is not represented for simplification of the drawing. The runner rail is attached to the side wall 3 by means of sections 5 and 5'. Near the front wall of the cabinet are supporting rollers (not represented) rotating about stationary axles which support the drawers so that they are guided in the cabinet on rollers. The lower horizontal leg 15 of Z-section 7 has a blocking projection 10 at its end and at a short distance, in front of said blocking projection, i.e. in the opening direction of the drawer, a further projection 11 is arranged. The LH side of the cabinet which is not represented in FIG. 1 is designed in the same manner as described, with the exception that it has no projections 10, 11. The projections 10 and 11 are of equal length measured transversely to the sliding direction of the drawers and are shaped such that the locking bolt can swivel between them.

A rectangular angle section 20 formed from metal with legs of equal lengths is supported vertically in the cabinet in such a manner that it can be swivelled into the positions marked by solid and chain-dotted lines. For this purpose, a pivot pin 21 is attached by welding in the upper end portion of the angle section 20, within the angle, so as to be rotatably supported in a stirrup 23 within a hole 22 formed in the stirrup, said stirrup being attached in the cabinet in a manner not represented in the drawing. In the same manner, the lower end of the angle section 20 is rotatably supported in a stirrup 23' by means of a pivot pin 21'.

On pivot pin 21 an essentially square plate 26 is supported which cannot be shifted in the axial direction but which can be swivelled, the swivel axis of the plate 26 — as shown in FIG. 1 — being located near its RH rear corner. On the side of the swivel axis remote from the projections 10 and 11 the plate 26 is provided with a slot 27 which is open towards the edge of plate. 26. A push-rod 28 which is formed of an angle-shaped sheet for stiffness is pivotally connected to a push-button lock 29 at one end, which is secured to the front wall 1 above the drawers. When the push-button 30 is actuated by finger pressure it shifts into a locked depressed position and is released only if the push-button lock is actuated by a key; in this case the push-button 30 is then returned to its outer end position by a spring 31. In FIG. 1 the released end position is represented by solid lines; in this position the drawers are released. The position of plate 26 and of push-rod 28, with the push-button lock 29 being unlocked, are represented by solid lines; the position of the push-rod 28, with the push-button lock 29 pressed into its locked position is partially represented by chain-dotted lines; this also applies to the push-button lock itself.

In its rear end portion the push-rod 28 is provided with a vertically downwardly projecting bolt 32 which engages in the slot 27 and which is secured against being lifted out of the slot 27. Thus, the push-rod 28 is also secured in its approximately horizontal position above the drawers. The bolt 32 can be displaced axially in the slot 27 which extends approximately in the longitudinal direction of the push-rod 28. As shown in FIG. 1 a spring 33 is provided which is designed as a tension spring has one end secured on a bent-out lobe at the edge 34 of plate 26 facing the front wall 1, the other end of the spring acting on the bolt 32. The closed end 35 of slot 27 facing the front wall 1 is thus closely engaged by the bolt 32. Upon depressing push-button 30 the bolt 32 is also displaced together with the push-rod 28 towards the rear wall 2 of the cabinet thereby tending to turn the plate 26 via spring 33 in the clockwise direction, as represented in FIG. 1.

In the vicinity of edge 34, approximately on the center line of plate 26, a two-armed lever 37 is pivotably arranged on the underside of said plate. The end of the longer arm 38 of the lever facing the front wall 1 is bent upwardly and a tension spring 36 is hooked with one end into the upwardly bent portion 39, the other end of the tension spring acting on the pivot pin 21. For a clearer arrangement of the drawing, only the two end portions of the spring are represented. The shorter arm 40 of lever 37 is provided with an elongated hole 41 extending in the longitudinal direction of the lever in which a vertically arranged pin 42 engages from below. The pin 42 is secured to a splice strap 43 which essentially extends horizontally and which is secured to a leg of the angle section 20 forming the lever arm 45. The angle section 20 itself does not extend up to the height at which the lever 37 is located. In order to avoid the risk that, for example, due to the manufacturing tolerances, the pin 42 can slip downwardly out of the elongated hole 41, an elongated hole 44 is arranged in the plate 26 in the area of motion of pin 42 and through which the pin 42 extends so that in the case of small mutual displacements pin 42 cannot slip out of the elongated hole 41. The elongated hole 44 has such a width and length that the pin 42 does not butt against the wall of the elongated hole 44. The tension spring 36 tends to move the upwardly bent portion 39 of lever 37 as close as possible to the pivot pin 21; this movement, however, is limited due to the fact that the pin 42 bears against the end 46 of the elongated hole 41 which faces away from the swivel axis of lever 37.

The lever 37 shown in the arrangement in FIG. 1 can therefore only swivel forward and backward within an angular range of approximately 90°; the two stable end positions are represented by solid and chain-dotted lines. As far as the spring 36 is concerned the intermediate positions of lever 37 are unstable. The other leg of the angle section 20 constitutes the locking bolt 48 of the arrangement. The locking bolt 48, together with the lever arm 45, forms an angle of 90°. When the lever 37 is in the position represented by solid lines, the locking bolt 48 is also in the position represented by solid lines and its rounded front face 50 in this case is spaced at a lateral distance from a blocking face 51 on the blocking projection 10. In the described position of the locking bolt 48 the drawers can be released.

The blocking projection 10 is provided with an oblique face 52 facing the rear wall of the cabinet, said oblique face having a smaller inclination relative to the sliding direction of the drawers than the blocking face 51 facing the front wall of the cabinet. The second projection 11 has two faces 53 and 54 the inclination of which is approximately the same as the inclination of the blocking face 51 and of the oblique face 52, the face 53 which is more inclined relative to the sliding direction facing the rear wall of the cabinet and the less inclined face 54 facing the front wall of the cabinet.

Between the two projections 10 and 11 the Z-section 7 has a relatively short face 55. The inclination of face 53 and the length of face 55 are designed so that the locking bolt 48 in its locked position, which is represented in FIG. 1 by chain-dotted lines, is accommodated by the intermediate space between the two projections 10 and 11. The length of the projection 11 (measured in the sliding direction of the drawer) is designed such that the end of the lever arm 45, in the release position of the locking bolt 48, is located in close vicinity to the end of face 54 facing the front wall of the cabinet. The result is that in the moment when a completely closed drawer is being withdrawn the face 54 which has the function of a stopping face bears against the lever arm 45 of the angle section 20 and, upon withdrawal of the drawer, swivels the lever arm 45 in the clockwise direction (as shown in FIG. 1) until the lever 37 has passed the position of the unstable equilibrium. Subsequently the lever 37 snaps into the position represented in FIG. 1 by chain-dotted lines and the swivel motion of the angle section 20 follows this movement of lever 37. The locking lever moves into the position represented by chain-dotted lines. Now, the edge 56 of the bearing face 50 of the locking bolt 48, said edge facing the rear wall 2 of the cabinet, is located opposite to the blocking face 51 and the front of face 50 is essentially located opposite to the face 55 between the two projections 10 and 11. In this position of the locking bolt no further drawers can therefore be opened. If opening attempts are made nevertheless the blocking face 51 of the drawer concerned butts against the edge 56 of the locking bolt 48 and tends to rotate the locking bolt clockwise, as shown in FIG. 1. This causes the front face 50 to be pressed against face 55 and thus turning of the locking bolt is prevented and at the same time the opening of further drawers is safely prevented. The relatively steep inclination of the blocking face 51 relative to the sliding direction of the drawer, the face 55 having the function of a stop, and the position of the swivel axis of the locking bolt thus exert a self-locking effect. The oblique rearwardly facing locking bolt 48 is able to take up large forces.

If the opened drawer is closed again, the oblique face 52 from the front butts against the locking bolt 48 which is in the locking position, whereby the latter — as shown in FIG. 1 — is swivelled anti-clockwise until the lever 37 snaps back into the position which is represented by solid lines and the locking bolt 48 also returns into the position which is represented by solid lines. Now, one of the drawers can be opened again. Due to the location of the swivel axis of pin 21 the direction of movement of the leg ends of the angle section 20, in the area of the projections 10 and 11, runs approximately transversely to the sliding direction of the drawers; for this reason the angle section can particularly easily be swivelled by the projections 10 and 11.

If the push-button 30 is depressed when the locking bolt 48 is in its drawer release position, in order to lock the push-button lock 29, the plate 26 — as shown in FIG. 1 — performs a clockwise swivel motion about the pivot pin 21. This swivel motion of plate 26 is completed when the push-button 30 and consequently also the push-rod 28 are no longer movable or when any part of the angle section 20 bears against a stop which impedes a clockwise swivel motion of angle section 20. This also blocks a further clockwise swivel motion of plate 26 because, due to the bearing of the pin 42 against the end 46 of the elongated hole 41 facing away from the pivot pin 21, with the angle section 20 being held in place, a further clockwise swivel motion of plate 26 relative to the angle section 20 is no longer possible. For this reason, if the clockwise rotational motion of plate 26 is blocked in the manner described, the spring 33 expands in the moment when the push-button 30 is depressed still further. In the embodiment represented the face 55 constitutes such a stop for the end of the locking bolt 48.

Figure 2:
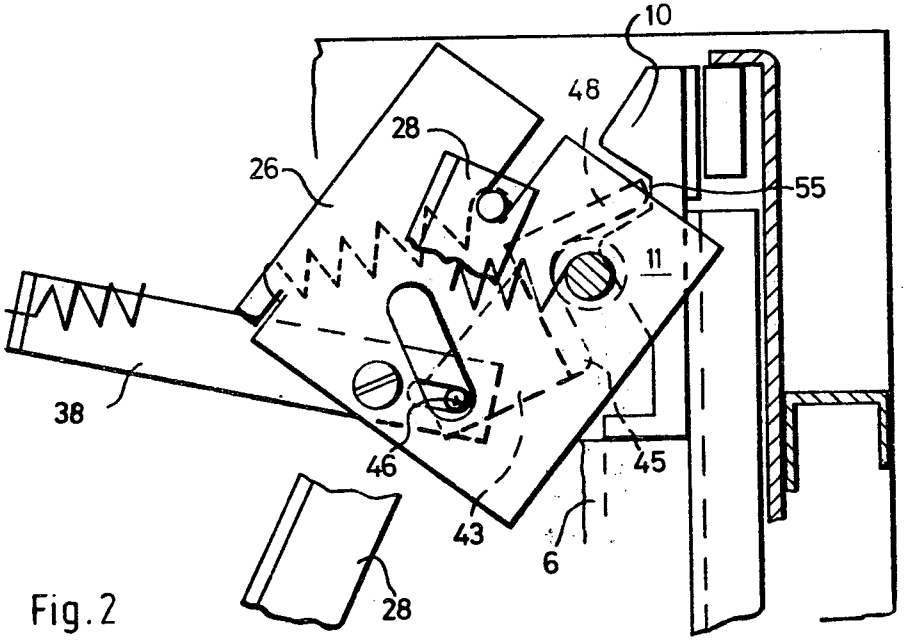
FIG. 2 is a view corresponding to FIG. 1 with the lock being locked (broken and enlarged view)
Figure 3:
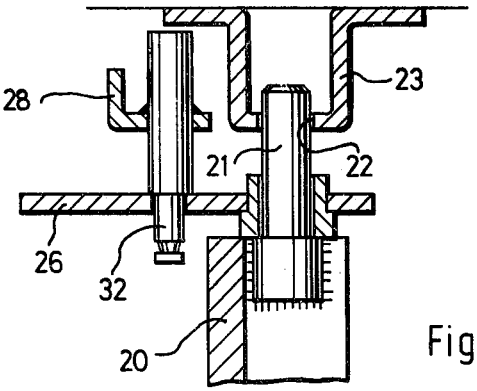
FIG. 3 is a section taken along the line III—III; of FIG. 1
Figure 4:
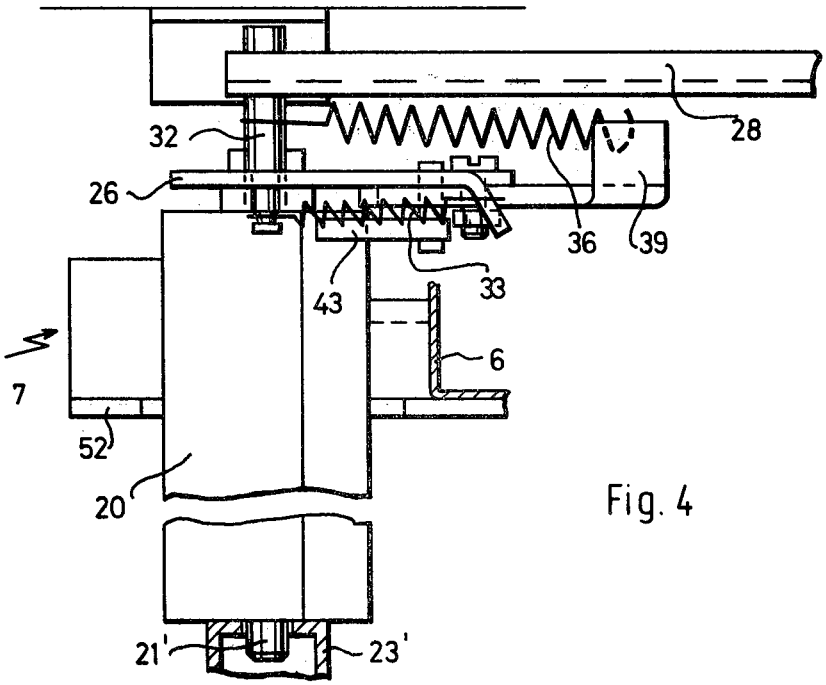
FIG. 4 is a view side elevational view of the device shown looking in the direction of the arrow IV in FIG. 1.

If the push-button 30 is fully depressed and the push-button lock 29 consequently locked, the plate 26, as represented in FIG. 2, is slightly rotated clockwise as compared to the position shown in FIG. 1 and the locking bolt 48, as described above, prevents the with drawal of closed drawers. Nevertheless, a drawer 6 which is still opened when locking the lock 29 can still be closed. In this case the oblique face 52 of the blocking projection 10 butts against the face of the locking bolt 48 facing the front wall 1 and thereby swivels the locking bolt 48 together with plate 26 sufficiently anti-clockwise that the blocking projection 10 is able to slide past the locking bolt 48, while the spring 33 is simultaneously expanding. Once the blocking projection 10 has passed the locking bolt 48, the plate 26, together with the locking bolt 48, is again rotated clockwise by the spring 33 so that the drawers are locked again.

If the angle section 20, with the push-button lock 29 being unlocked, is in the locking position, i.e. in the position shown in FIG. 1 by chain-dotted lines and if now the push-button 30 is depressed, first the plate 26 is also swivelled clockwise until the locking bolt 48 bears against face 55. In relation to tension spring 36 spring 33 is designed so that, upon further depressing of the push-button 30, the plate 26 is further rotated. During this rotation the angle section 20 performs an anti-clockwise movement relative to plate 26 until the lever 37 swivels round into the position represented by solid lines. Now, the push-button 30 is partially depressed and the angle section 20, relative to the already partially swivelled plate 26 moves into the position which is represented by solid lines. Now, if the push-button is further depressed, the plate 26 together with the angle section 20 continues to perform a clockwise rotation until, as explained above, the locking bolt 48 bears against face 55 or until the push-button lock 29 has already previously attained its locking position. If the push-button lock 29 is subsequently unlocked again the locking bolt 48 is in the release position. Irrespective of the fact whether the locking bolt 48 has been in the locking position or in the release position prior to the blocking of the push-button lock 29, after the unlocking of the push-button lock 29 the locking bolt 48 consequently moves into its release position so that a drawer can be opened. Thus it is possible for example for maintenance to withdraw several drawers by depressing and unlocking the push-button lock after every withdrawal of a drawer.

In case, after a drawer has already been withdrawn, a further drawer is withdrawn after the depressing and unlocking of the push-button lock 29, the locking bolt 48 — as shown by chain-dotted lines in FIG. 1 — is in the position in which the withdrawal of further drawers is blocked. Now, if one of the two withdrawn drawers is closed again the locking bolt thereby swivels into the release position which is represented by solid lines, i.e. in which position the withdrawal of the same or of another drawer is possible. However, in this position of the locking bolt the end of the lever arm 45 projects into the path of the blocking projection of the withdrawn drawer. Now, if this withdrawn drawer is also closed the blocking projection 10 butts against the lever arm 45. However, when closing the drawer, the lever arm 45 is swivelled clockwise as shown in FIG. 1. so that the blocking projection can be rearwardly pushed past the lever arm 45. During the displacement of the lever arm 45 by the oblique face 52 the lever 37 swivels into its other position so that now the locking bolt moves into the position which is represented by chain-dotted lines. Now, if the drawer is pushed still further in the rearward direction the oblique face 52 which now butts against the face of locking bolt 48 facing the front wall of the cabinet swivels the locking bolt anti-clockwise so that the blocking projection 10 can pass the locking bolt 48. During this phase the locking bolt swivels back into its drawer release position, the lever 37 also pivoting into its other end position. When only one drawer is opened the lever 37 changes its position only once when this drawer is being closed whereas when several drawers are withdrawn the lever 37 pivots twice when the second and every further drawer is being closed. The oblique face 52 and the shape of the free end of the lever arm 45 must be designed so that, at the moment when the locking bolt is in the release drawer position, the lever arm 45 can easily be swivelled out of the path of the blocking projections 10 when a still opened drawer is being closed.

In the described embodiment it is consequently possible that, in case several drawers had been opened by corresponding actuation of the push-button lock, all the drawers can be closed again, irrespective of the position of the push-button lock and the position of the locking bolt 48 and the location of lever arm 45.

In the embodiment described the lever 37 does not project into the slide path of the drawers and the plate 26 (cf. FIG. 2) only with a small portion of one corner projects into the area of the sliding path. If desired, this can also be avoided, for example by cutting the corner since the external shape of the plate 26 is of no importance for the function of the described embodiment.

Having thus fully described my invention, what I claim as new and wish to secure by Letters Patent is:

1. A central locking mechanism for an item of furniture having a plurality of drawers arranged side by side or one above the other comprising a blocking projection and a second projection spaced from said blocking projection having a stopping face thereon integral with each of said drawers and arranged transversely to the sliding direction of the respective drawer, a locking bolt extending beyond all of said drawers pivotable about a stationary axis into the path of movement of the blocking projections, said stationary axis extending parallel to the longitudinal axis of the locking bolt so that the closed drawers cannot be withdrawn and said locking bolt, in the locked position of the central locking mechanism, being pivotable against the force of a spring out of the blocked position when an opened drawer is being closed, a driving member, a bistable member coupling said driving member and said locking bolt, said locking bolt being connected to a lever arm which, in the unlocking position of the locking bolt, projects into the path of said stopping face so that the stopping face is engageable with the lever arm when opening a drawer and the locking bolt is pivotable into the locking position.

2. A locking mechanism according to claim 1 wherein said locking bolt and lever arm comprise the legs of an angle section.

3. A locking mechanism according to claim 1 wherein the stationary pivot axis of the locking bolt extends within the angle formed by the legs of the angle section.

4. A locking mechanism according to claim 1, wherein the blocking projection of each drawer is providing with an oblique face engageable with and adapted to displace by such engagement the lever arm when the drawer is closed.

5. A locking mechanism according to claim 1, wherein said driving member comprises a plate arranged to pivot about the pivot axis of the locking bolt an actuating member operatively connected to the said plate in such a manner that the plate is pivoted upon actuation of said actuating member, said bistable member being arranged on the said plate in pivotable manner, said bistable member comprising a two-armed lever, one arm of the said lever having an elongated slot formed in one arm thereof extending in the longitudinal direction of the lever, a pin member connected to said locking bolt projecting into and slidable within said elongated slot, said pin member being located closer to the pivot axis of the locking bolt than the pivot axis of the lever, and the other arm of the lever being connected with the pivot axis of the locking bolt by means of a tension spring, the pivot angle of the two-armed lever between the two stable positions being at least approximately 45°.

* * * * *